US008330099B2

(12) United States Patent
Flory et al.

(10) Patent No.: US 8,330,099 B2
(45) Date of Patent: Dec. 11, 2012

(54) MASS SPECTROMETER AND MASS ANALYZER COMPRISING PULSER

(75) Inventors: Curt A. Flory, Los Altos, CA (US); Trygve Ristroph, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 79 days.

(21) Appl. No.: 13/075,253

(22) Filed: Mar. 30, 2011

(65) Prior Publication Data

US 2012/0193524 A1 Aug. 2, 2012

(51) Int. Cl.
*H01J 49/40* (2006.01)

(52) U.S. Cl. ..... 250/287

(58) Field of Classification Search ..... 250/287, 250/396 R

See application file for complete search history.

(56) References Cited

U.S. PATENT DOCUMENTS

| | | | | |
|---|---|---|---|---|
| 3,040,173 | A * | 6/1962 | Higatsberger | 250/293 |
| 3,949,221 | A | 4/1976 | Liebl | |
| 7,977,649 | B2 * | 7/2011 | Hirano | 250/396 R |
| 2008/0290269 | A1 * | 11/2008 | Saito et al. | 250/287 |
| 2010/0243886 | A1 | 9/2010 | Flory et al. | |

OTHER PUBLICATIONS

Bergmann, et al. "High-resolution time-of-flight mass spectrometers: Part I. Effects of field distortions in the vicinity of wire meshes" Rev. Sci. Instrum, 60 (3), Mar. 1989.

Wiley, et al. "Time-of-flight mass spectrometer with improved resolution" Rev. Sci. Instrum. 26 (12), Dec. 1955.

Co-pending U.S. Appl. No. 13/017,101, filed Jan. 31, 2011.

* cited by examiner

*Primary Examiner* — Kiet T Nguyen

(57) ABSTRACT

A mass analyzer comprises a pair of planar electrode structures. The electrode structures are disposed opposite one another, parallel to one another, and axially offset from one another. One of the pair of planar electrodes comprises an opening. The mass analyzer comprises an ion mirror disposed between the pair of planar electrodes. A mass spectrometer and a mass spectrometry method are also described.

18 Claims, 9 Drawing Sheets

MASS SPECTROMETER AND MASS ANALYZER COMPRISING PULSER

CROSS REFERENCE TO RELATED APPLICATIONS

The present application is related to U.S. patent application Ser. No. 12/415,915 entitled "Cylindrical Geometry Time-of-Flight Mass Spectrometer" naming Curt A. Flory and Trygve Ristroph as inventors, and filed on Mar. 31, 2009. The entire disclosure of U.S. patent application Ser. No. 12/415,915 is specifically incorporated herein by reference.

BACKGROUND

Mass spectrometry is a common analytical technique used in the physical and biological sciences. Time-of-flight mass spectrometry (TOF-MS) is one mass spectrometry technique used for analytical measurements. TOF-MS has such desirable characteristics as an almost limitless mass range, an ability to provide a complete mass spectrum from each ionization event, and relatively simple operational principles.

A TOF mass spectrometer is composed of an ion injector, a mass analyzer and an ion detector. A packet of ions derived from a sample is input to the ion injector. The packet of ions is typically composed of ions of multiple, different ion species having respective mass-to-charge ratios. An electrical pulse applied to the ion injector imparts approximately the same initial kinetic energy to all the ions in the packet of ions in such a manner that the ions all move in approximately the same direction of travel. The ions of each ion species travel at a respective velocity that depends on the mass-to-charge ratio of the ion species. The ions pass into the mass analyzer, which, in its simplest implementation, is an elongate evacuated chamber. In the mass analyzer, the differing velocities of the different ion species cause the ions of the respective ion species to separate in the direction of travel. At the distal end of the mass analyzer, the ions are incident on the ion detector, which measures the abundance of ions incident thereon within successive narrow time-of-flight windows to produce a time-of-flight spectrum. The time-of-flight spectrum represents the relationship between ion abundance and time of flight. Since the time of flight of the ions of a given ion species is proportional to the square root of the mass-to-charge ratio of the ion species, the time-of-flight spectrum can be converted directly to a mass spectrum that represents the relationship between ion abundance and mass-to-charge ratio. In this disclosure, for brevity, term mass-to-charge ratio will be abbreviated as mass.

The mass resolution in a mass spectrometer is defined as $T/2\Delta T$, where T is the measured time of flight at a given mass, and $\Delta T$ is the measured or calculated time-of-flight spread for that given mass. For a TOF mass spectrometer, the square root dependence of the time of flight on the mass dictates that, for large masses, the peak separation decreases inversely with the square root of the ion mass. In recent years there has been a significant increase in applications of mass spectrometry to large biological molecules. Such applications have mass resolution demands that exceed the capabilities of conventional TOF-MS systems. To make TOF mass spectrometers, with their many other desirable characteristics, viable for use in such applications, their mass resolution must be increased.

The mass resolution of a TOF mass spectrometer is proportional to the length of the flight path between the ion injector and the ion detector. A typical TOF mass spectrometer has a linear flight path. Increasing the physical length of such linear flight path until the required resolution is reached would increase the physical dimensions of the instrument beyond those considered reasonable.

A cylindrically symmetric mirror structure such as disclosed in the above-referenced applications to Flory, et al. provides comparatively large flight paths for ions in a mass analyzer, while beneficially reducing the physical dimensions of the mass analyzer compared to mass analyzers with a linear flight path. In cylindrically symmetric mirror structures, the ions from an ion source follow eccentric orbits that slowly precess about an axis of axial symmetry and ultimately are intercepted by the ion detector. The motion in the axial dimension is roughly periodic about the symmetry plane of the cylindrically symmetric mirror structure, located approximately midway between the parallel planar surfaces While cylindrically symmetric mirror structures beneficially reduce the required physical space without sacrificing resolution compared to mass analyzers with a linear flight path, incorporation of ion sources into such mass analyzer has been difficult.

Accordingly, what is needed is an ion source for a cylindrically symmetric mass analyzer.

SUMMARY

In a representative embodiment, a mass spectrometer comprises a mass analyzer, an ion source and an ion detector. The mass analyzer comprises a pair of planar electrode structures and an ion mirror disposed between the pair of planar electrodes. The electrode structures are disposed opposite one another, parallel to one another, and axially offset from one another. One of the pair of planar electrodes comprises an opening. The ion source comprises an ion pulser disposed outside of the mass analyzer and configured to direct ions into the opening in the one planar electrode.

In another representative embodiment, a mass analyzer comprises a pair of planar electrode structures. The electrode structures are disposed opposite one another, parallel to one another, and axially offset from one another. One of the pair of planar electrodes comprises an opening. The mass analyzer also comprises an ion mirror disposed between the pair of planar electrodes.

In another representative embodiment, a mass spectrometry method comprises: directing ions toward an ion pulser; directing the ions from the pulser to an opening in one of a pair of planar electrodes and toward an ion mirror; and reflecting the ions from the ion mirror to an ion detector.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of description. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

A mass spectrometer comprising an ion source, a mass analyzer and an ion detector are described in connection with representative embodiments. The ion source comprises an ion injector that is configured to interface a continuous low-energy ion beam to a cylindrical geometry mass analyzer comprising an ion mirror. The ion minor is configured to direct ions from the ion injector through the electric field established in the mass analyzer and to the ion detector. Beneficially, the ion injector of the representative embodiment also allows a relative orientation between the input low-energy ion beam and the cylindrical geometry mass analyzer whereby the low-energy ion beam and the mass analyzer are parallel to the laboratory bench-top.

Figure 1:
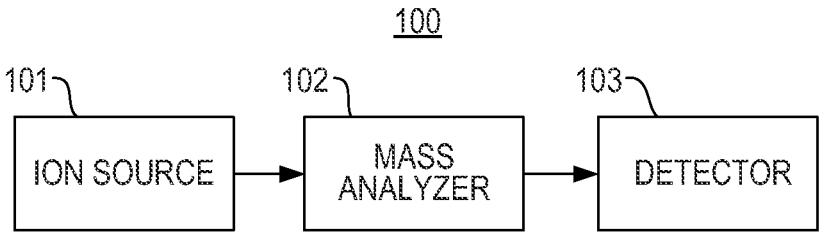
FIG. 1 is a simplified schematic block diagram of a mass spectrometer in accordance with a representative embodiment.

FIG. 1 is a simplified schematic block diagram of a mass spectrometer 100 in accordance with a representative embodiment. The mass spectrometer 100 comprises an ion source 101, a mass analyzer 102 and an ion detector 103.

As described more fully below, the ion source 101 comprises a Wiley-McLaren pulser ("pulser") (not shown in FIG. 1) configured to receive a low energy ion beam (not shown in FIG. 1) and to direct ions from the pulser to the mass analyzer 102. The mass analyzer 102 of various embodiments described below may be as described in U.S. patent application Ser. No. 13/017,101 to Flory, et al., referenced above, and modified to receive ions from the pulser as described in connection with representative embodiments below. It is emphasized that this is merely illustrative, and other mass analyzers are contemplated for use in connection with the mass spectrometer of the representative embodiments. For example, mass analyzer 102 may be as described in connection with U.S. patent application Ser. No. 12/415,915 to Flory, et al., referenced above, and modified to receive ions from the pulser as described in connection with representative embodiments below.

In accordance with the present teachings, analyte material originates from the continuous elution output of a chromatography column (not shown). The analyte material is first ionized by one of the many techniques known to those skilled in the art such as, but not limited to, electrospray ionization, electron impact ionization, photo ionization, or chemical ionization. The resultant analyte ion beam is typically conditioned regarding cross-section, angular distribution, energy distribution, and fragmentation state using techniques known to those skilled in the art. This yields low-energy ion beam that is interfaced to the mass analyzer 102 with its requirement of discontinuous input pulses of analyte ions (referred to below as "packet of ions").

Figure 2A:
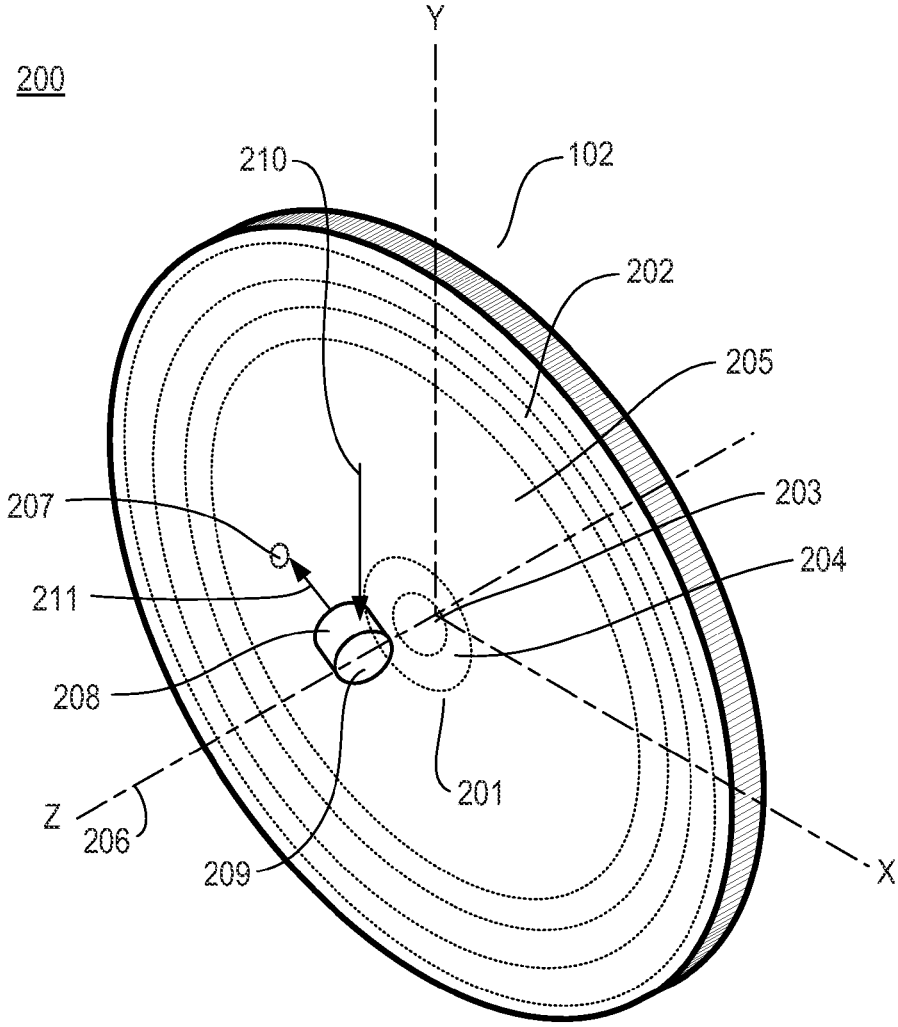
FIG. 2A is a schematic view of a mass spectrometer in accordance with a representative embodiment.

FIG. 2A shows a perspective view of mass analyzer 102 in accordance with a representative embodiment. The mass analyzer 102 comprises a central lens 201 and annular electrodes 202. The central lens 201 comprises an inner electrode 203, intermediate electrode 204 and outer electrode 205.

The inner electrode 203, the intermediate electrode 204 and the annular electrodes 202 are illustratively concentric about the axis of symmetry 206 (along the z-axis in the coordinate system shown in FIG. 2A). As described in U.S. patent application Ser. No. 13/017,101 to Flory, et al., with selective application of voltages to the electrodes of the central lens 201 and the annular electrodes 202, a cylindrically-symmetric, annular electric field is established comprising an annular radially focusing central lens region ("central lens region" shown below in FIG. 2A) surrounding the axis of symmetry 206, an annular minor region surrounding the central lens region, and a field free region (shown below in FIG. 2A) between the central lens 201 and the annular electrodes 202.

Alternatively, using the electrode structure described in U.S. patent application Ser. No. 12/415,915 to Flory, et al., selective application of voltages to electrodes result in the generation of a cylindrically-symmetric, annular electric field surrounding a cylindrical central region (not shown). The electric field comprises an annular axially focusing lens region surrounding the central region, and an annular minor region surrounding the lens region.

An opening 207 is provided in the outer electrode 205. The opening 207 allows a packet of ions ("ion packet") 211 from a pulser 208 to travel into the mass analyzer 102 and be directed toward the central lens 201 and into the electric field generated in the mass analyzer 102.

As described more fully below, the pulser 208 is illustratively a so-called Wiley-McLaren (W-M) pulser. The pulser 208 is positioned near the radial center of the mass analyzer and above the top planar surface of the mass analyzer 102 as illustrated in the cross-sectional view of FIG. 2D and the top-view of FIG. 2E. The pulser 208 is illustratively cylindrically shaped and comprises two "gratings" disposed parallel to an electrically conductive backing plate ("backing plate") 209 as seen in FIGS. 2D and 2E. In a representative embodiment, the gratings of the pulser 208 comprise two sets of parallel electrically conducting wires. As described more fully below, voltage pulses are applied to the gratings of the pulser 208, in a manner well known to one skilled in the art, to direct an ion packet 211 in a direction approximately orthogonal to the incident direction of the low-energy ion beam, as depicted in FIGS. 2D and 2E. The pulser 208 is oriented to accommodate for the initial velocity of the low energy ion beam 210 by rotation of the pulser 208 about an axis parallel to the axis of symmetry 206 by an amount equal to the natural angle described below, and as shown in FIG. 2E. Furthermore, the pulser 208 is oriented to direct the ion packet 211 through the opening 207 into the mass analyzer 102, as shown in FIG. 2D.

After the ion packet 211 is directed through the opening 207 and enters the mass analyzer 102, the ion packet 211 is reflected by a single-stage ion mirror 212 ("ion mirror") comprised of a single "grating" (comprised of a set of parallel wires) disposed parallel to a conductive backing plate and well known to those of ordinary skill in the art. The ion minor 212 reflects the ion packet into the symmetry plane of the mass analyzer 102 as shown in FIGS. 2D and 2E. The location of the ion mirror 212 is advantageously chosen to coincide with the nominal ion source position disclosed in the above-referenced applications by Flory et al., and oriented to effect the deflection of the ion packet 211 along the direction of the input ion source as disclosed by Flory et al.

Figure 2B:
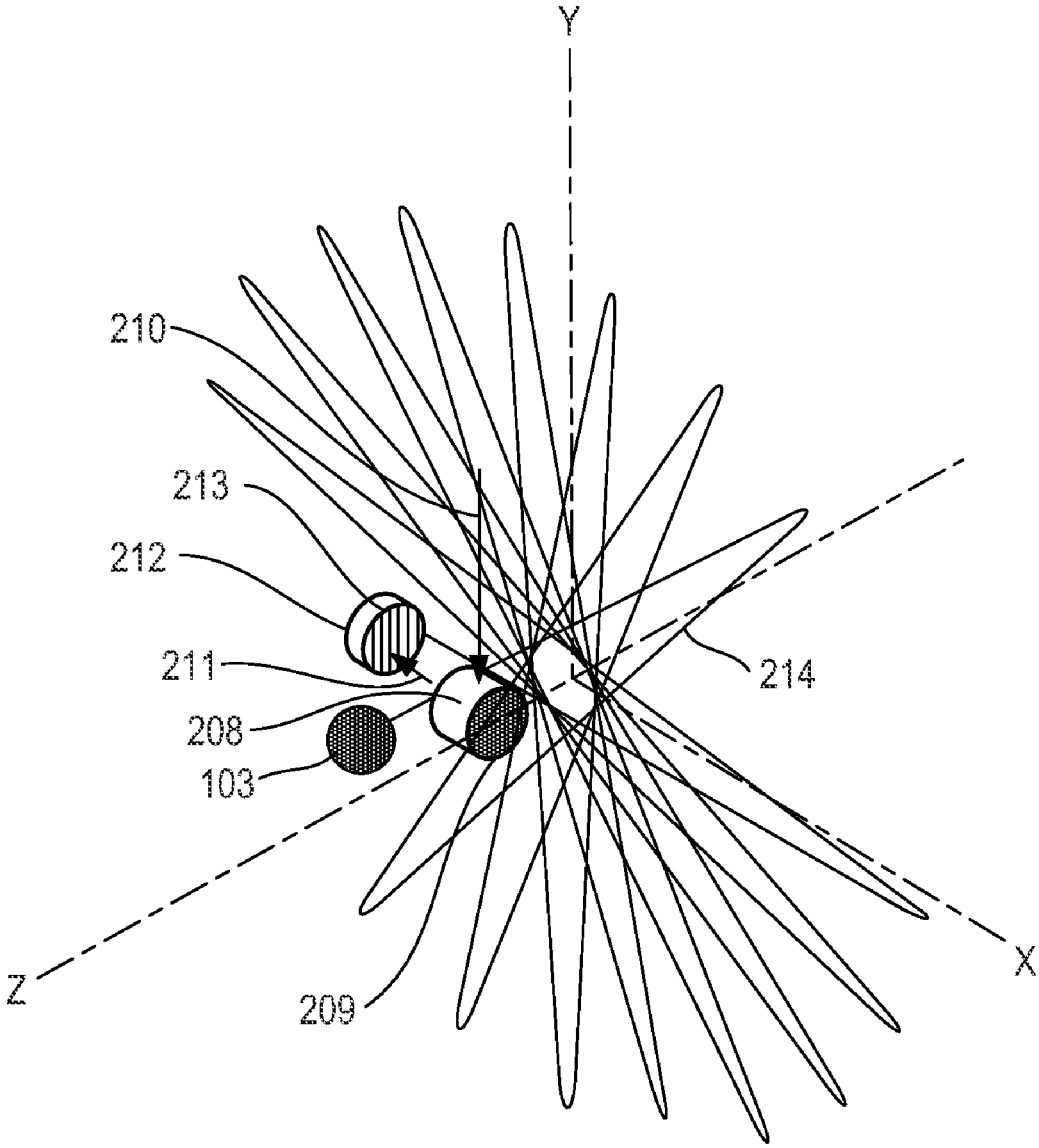
FIG. 2B is a schematic view of a mass spectrometer in accordance with a representative embodiment.

FIG. 2B shows the mass spectrometer 200 with the electrode structure of the mass analyzer 102 removed so that the complete flight path of ions from the low energy beam to the ion detector 103 can be more readily viewed. The low energy ion beam 210 is directed to the pulser 208, from which the ion packet 211 emerges. The ion packet 211 passes through the opening 207 (not shown in FIG. 2B) and is incident on the ion mirror 212. The ion packet 211 is directed by the ion mirror 212 along the symmetry plane of the mass analyzer. The ion packet 211 then follows the "precessing elliptical orbit trajectory" of the mass analyzer 102, as previously disclosed by Flory et al., until their subsequent termination at the ion detector 103.

The pulser 208 is oriented to accommodate for the initial velocity of the low energy ion beam 210 (along the y-axis in of the coordinate system shown in FIG. 2B) by rotation of the pulser 208 by an amount equal to the natural angle ($\Theta_n$) described below. In addition, the pulser 208 is rotated to direct the ion packet 211 through the opening 207 and at substantially normal incidence to the plane of single wire grid 213 of the ion mirror. The ion mirror 212 is rotated to ensure proper direction of the ion packet 211 reflected therefrom and toward the radial center of the mass analyzer 102.

The electric field established in the mass analyzer 102 causes the ion packet 211 reflected by the ion mirror 212 to execute a number of elliptical orbits 214 in a flight path that extends from the ion minor 212 to ion detector 103 (not shown in FIG. 2B). As depicted in FIG. 2B, the ions of ion packet 211 precess in elliptical orbits 214, and after a prescribed number of executed orbits (e.g., 10), are incident on the ion detector 103. Notably, the orbits 214 executed by the ions are described as "elliptical" to simplify the description. In some embodiments, the cylindrically-symmetric, annular electric field established in the mass analyzer 102 has properties that cause the ions to execute orbits that quite closely resemble ellipses. In other embodiments, the electric field established in the mass analyzer 102 has properties that cause the ions to execute orbits that depart significantly from the elliptical, especially in the turn-around regions where the radial component of the velocity vector representing the ions' direction of travel along the orbit changes sign, i.e., from radially outwards to radially inwards.

Figure 2C:
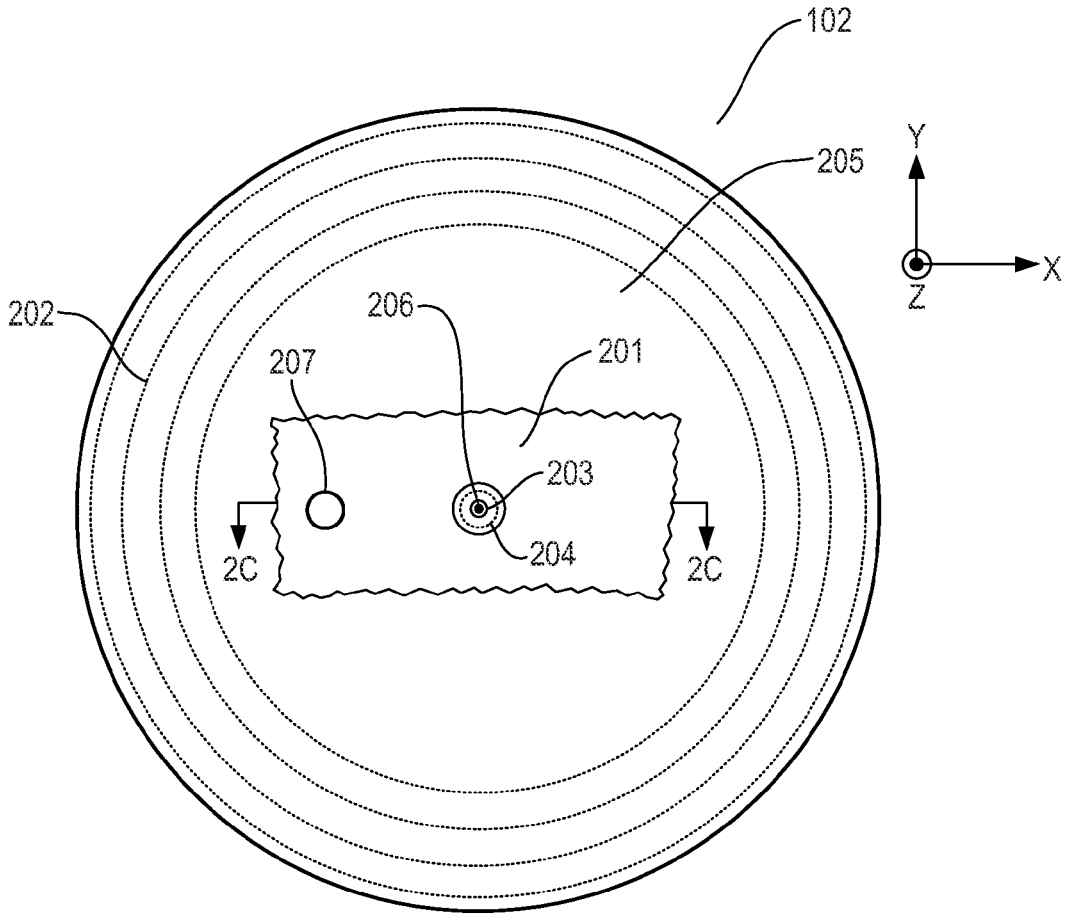
FIG. 2C is a top view of a mass analyzer in accordance with a representative embodiment.
Figure 2D:
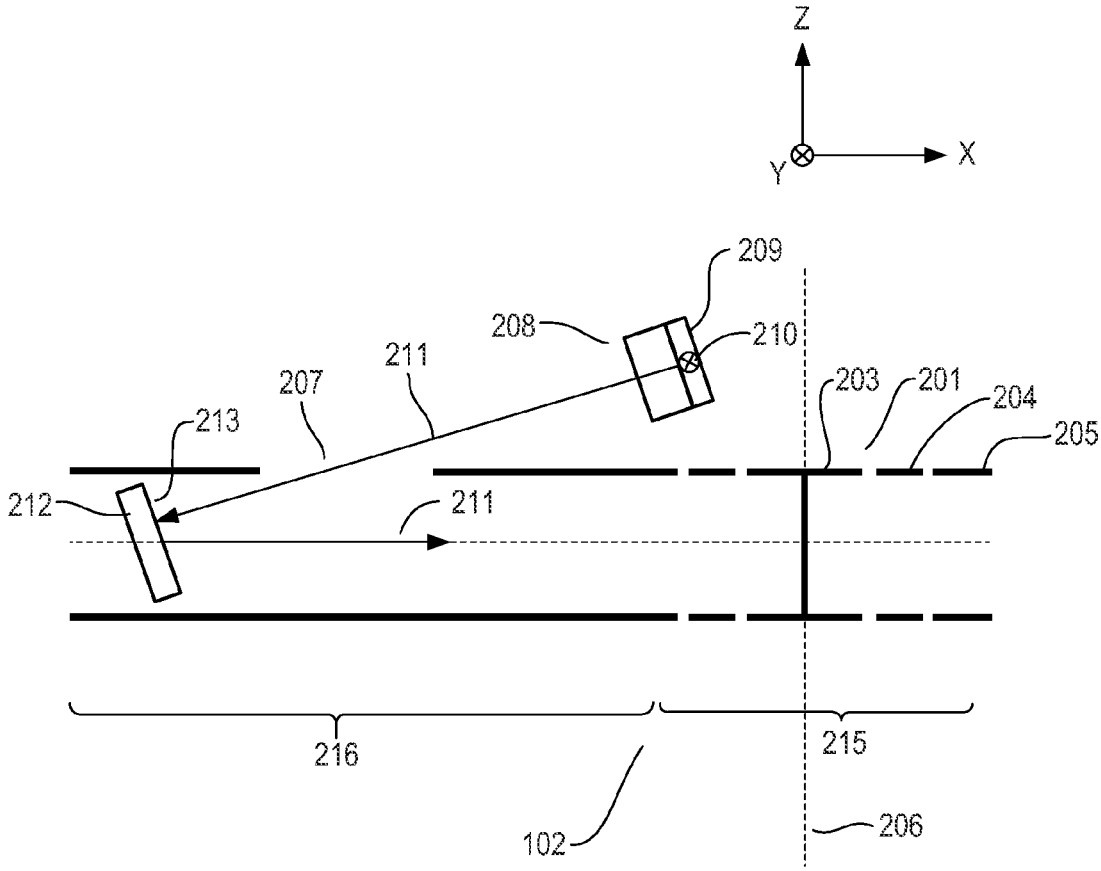
FIG. 2D is a cross-sectional view of a portion of the mass analyzer shown in FIG. 2C along the section line 2C-2C.
Figure 2E:
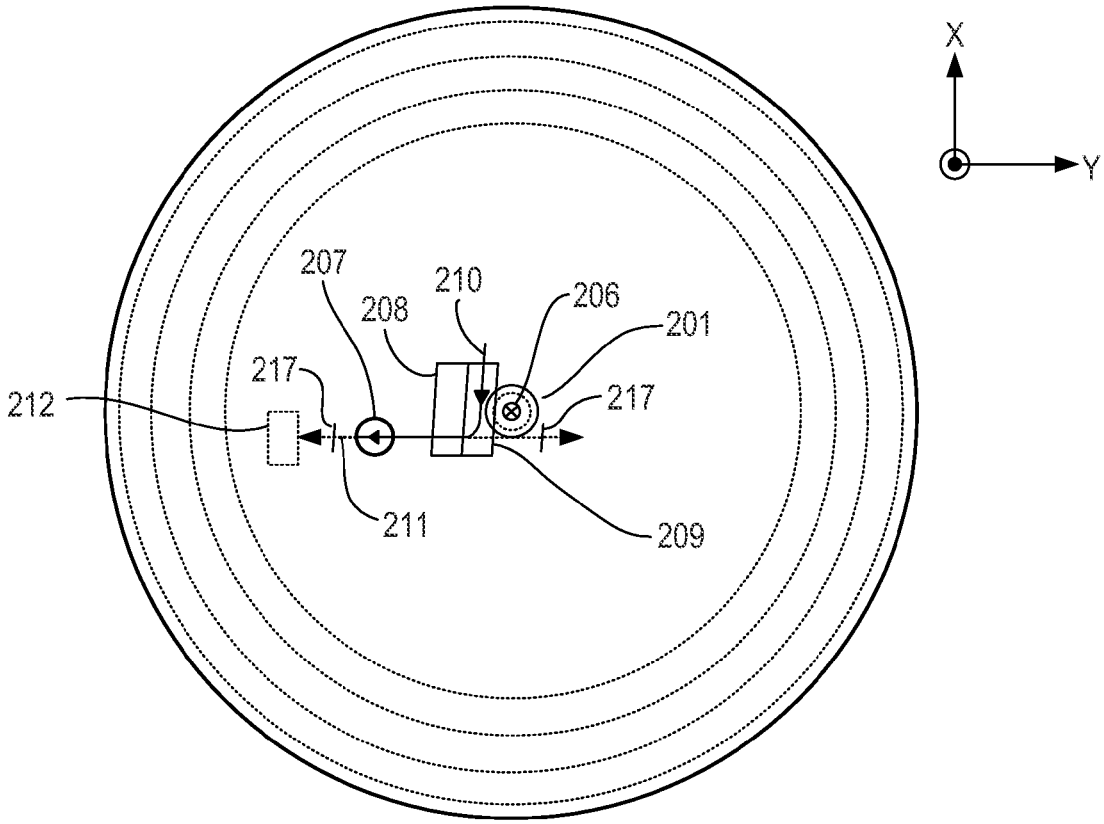
FIG. 2E is a top view of a mass spectrometer in accordance with a representative embodiment.

FIG. 2C shows a top view of the mass analyzer 102. The mass analyzer 102 comprises a central lens 201 and annular electrodes 202. The central lens 201 comprises inner electrode 203, intermediate electrode 204 and outer electrode 205. The pulser 208 (not shown in FIG. 2C) is disposed above and offset from the central lens 201. The low energy ion beam 210 (not shown in FIG. 2C) travels parallel to the plane of symmetry of the mass analyzer 102 and is incident on the pulser 208. The pulser 208 directs ion packet 211 (not shown in FIG. 2C) toward the opening 207 provided in the outer electrode 205. The ion packet 211 passes through the opening 207 and is reflected by the ion mirror 212 toward the axis of symmetry 206 as described above.

FIG. 2D is a cross-sectional view of a portion of the mass analyzer shown in FIG. 2C along the section line 2C-2C. The pulser 208 receives low energy ion beam 210 and directs ion packet 211 through the opening 207 and toward ion mirror 212, which is positioned in a field-free region 216 of the mass analyzer 102. The ion packet 211 is reflected by the ion minor 212 in the symmetry plane (x-y plane in the coordinate system of FIG. 2D) of the mass analyzer 102 toward the central lens region 215 of the mass analyzer 102. Notably, the ion mirror 212 is positioned at the desired effective "ion source" position within the mass analyzer 102 (e.g., located at the ion source position of the referenced application to Flory, et al.) The ion mirror 212 is rotated to direct the ion packet 211 in the plane of the mass analyzer 102 (x-y plane of the coordinate system shown in FIG. 2D). Moreover, the ion mirror 212 is positioned so that the ion packet 211 passes through the central lens 201 at the optimum radial distance as disclosed in the referenced application to Flory, et al.

FIG. 2E shows a top view of the mass analyzer 102. The mass analyzer 102 comprises a central lens 201 and annular electrodes 202. The central lens 201 comprises inner electrode 203, intermediate electrode 204 and outer electrode 205. The pulser 208 is disposed above (along the axis of symmetry 206) and offset from the central lens 201. The low energy ion beam 210 travels parallel to the plane of symmetry of the mass analyzer 102 (x-y plane of the coordinate system depicted in FIG. 2E) and is incident on the pulser 208. The pulser 208 directs ion packet 211 toward the opening 207 provided in the outer electrode 205. The ion packet 211 passes through the opening 207 and is reflected by the ion minor 212 toward the axis of symmetry 206 as described above. As described below, the ion packet 211 has a beamfront 217 that is "tilted" relative to the direction of motion of the ion packet 211, and thus is not perpendicular to the direction of motion of the ion packet 211.

Figure 3:
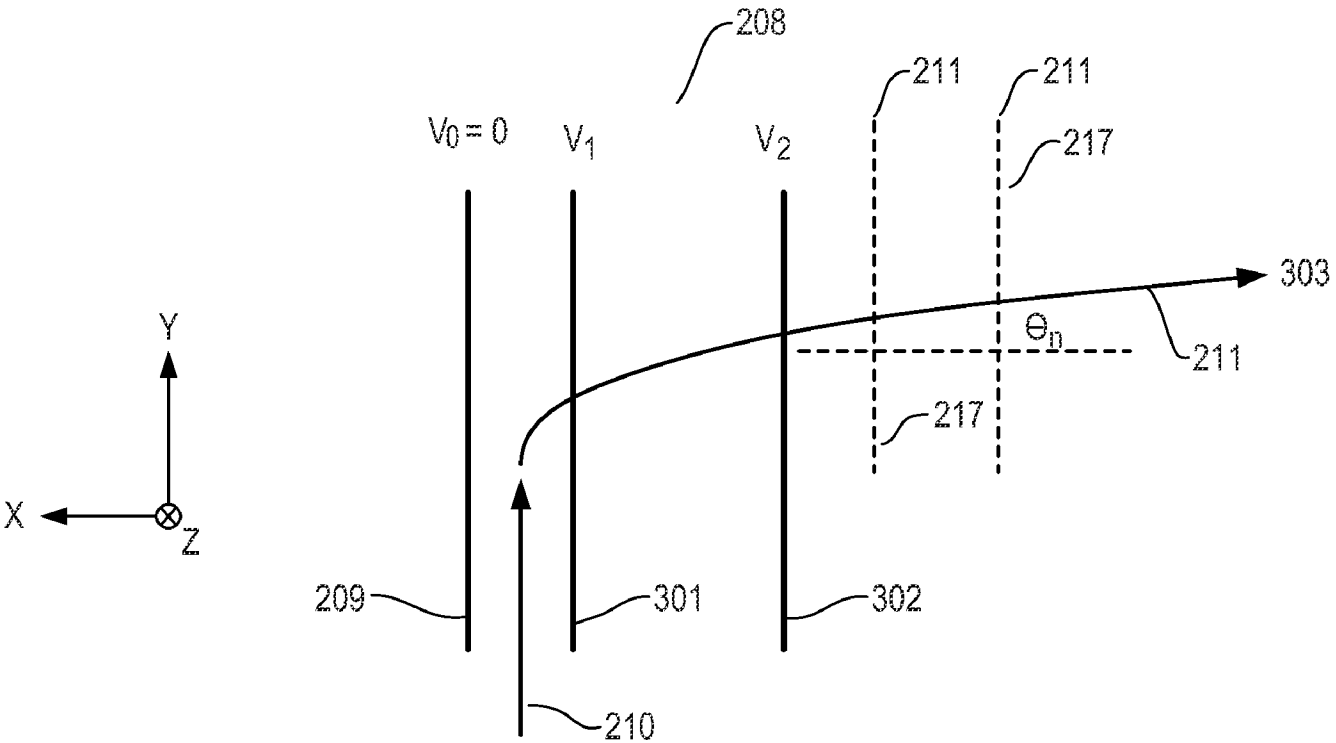
FIG. 3 is a simplified schematic view of a pulser in accordance with a representative embodiment.

FIG. 3 is a simplified schematic view of pulser 208. In representative embodiments the pulser 208 is a W-M orthogonal ion pulser and functions as the ion source 101 of the mass spectrometer 100. The use of a W-M orthogonal ion pulser is merely illustrative, and other types of pulsed ion sources are contemplated. Generally, the ion source 101 of representative embodiments is configured to receive a (continuous) low-energy ion beam (e.g., low energy ion beam 210) along an incident direction and provide packets of ions (e.g., ion packet 211) in a direction approximately orthonormal to the incident direction of the low energy ion beam 210.

The low energy ion beam 210 is received at the pulser 208 from the ionization source (not shown) along the y-direction in the coordinate system shown in FIG. 3. The pulser 208 comprises backing plate 209, a first electrically conductive grating ("first grating") 301 and a second electrically conductive grating ("second grating") 302. The first grating 301 and the second grating 302 each comprises a plurality of parallel conductive wires, as is well known to those skilled in the art. In the preferred embodiment, the parallel conductive wires are oriented in the direction perpendicular to the low-energy ion beam. The reason for this orientation is the following. It is well known to those skilled in the art that metal grid wires can deflect ions as they pass in close proximity to said wires. These deflections occur only in the direction normal to the plane defined by the incident ion trajectory and the grid wire. Thus, the above specified grid wire orientation will restrict ion deflections to be perpendicular to the plane defined by the ion trajectory and the symmetry axis of the mass analyzer, as seen in FIG. 2D. As shown below, this has significant advantages for the performance of the mass analyzer. Additionally and for these same reasons, it is to be noted that the preferred embodiment of the ion mirror 212 has its grid wires oriented parallel to the plane defined by the trajectory of the ion packet incident upon said ion mirror and the axis of symmetry 206 of the mass analyzer 102.

The low energy ion beam 210 is directed along the y-axis of the coordinate system of FIG. 3 and between the backing plate 209 and the first grating 301. The backing plate 209 and the first grating 301 are held at zero voltage difference with respect to the low energy ion beam 210 (i.e. $V_0=0, V_1=0$). The second grating 302 is held at a large negative (for positive ions) voltage ($V_2$) representative of the desired energy of the ion packet 211 entering the mass analyzer 102 through opening 207. As the low energy ion beam 210 passes through the region between the backing plate 209 and the first grating 301, the voltage $V_1$ applied to the first grating 301 is rapidly pulsed to a value intermediate between $V_0$ and $V_2$, causing an ion packet 211 to be ejected in a direction nominally orthonormal to the original direction of the low energy ion beam 210. The voltage $V_1$ is returned to zero until another ion packet 211 is required by the mass analyzer 102. However, because of the initial velocity of the low-energy ions along the y-direction in the coordinate system shown in FIG. 3, ion packet 211 travels in a direction that deviates from a direction normal to the second grating 302 due to the non-zero velocity of the low-energy beam. This angle is typically small (<5 degrees) due to the large ratio of the final and initial beam energies, and is commonly referred to as the natural angle, $\Theta_n$.

The origin of the natural angle $\Theta_n$ is the fact that the final velocities of the ion packet 211 accelerated by the pulser 208 are not perpendicular to the second grating 302 of the pulser 208. This is a result of the non-zero energy of the low energy ion beam 210 entering the pulser 208 perpendicular to the direction of acceleration of ions of the low energy ion beam 210. It can be shown that the natural angle $\Theta_n$ is given by:

$$\theta_n = \operatorname{atan}\left(\sqrt{\frac{E_i}{E_0}}\right)$$

where $E_i$ is the initial kinetic energy of the low energy ion beam 210 and $E_o$ is the kinetic energy of the ion packet 211.

The beamfront 217 of the ion packet 211 is parallel to the second grating 302, and thus is not perpendicular to the direction 303 of the ion packet 211 after acceleration by the pulser 208. This results in beamfront tilt. As can be seen in FIGS. 2D and 2E, the explicit orientation of the pulser 208 results in the beamfront tilt being in the symmetry plane of the mass analyzer. Thus, the effects of the beamfront tilt can be completely eliminated by a corresponding rotation of the ion detector 103 in the symmetry plane of the mass analyzer 102. As disclosed in the referenced patent application to Flory, et al., the tilt of the ion detector 103 is already an optimized parameter, and merely needs to be adjusted to completely mitigate the effects of beamfront tilt.

EXAMPLE

The following example is provided to illustrate certain aspects of representative embodiments and to describe certain considerations to account for physical effects associated with the mass spectrometer 100 and the various components. The example is illustrative and not limiting of the scope of the present teachings.

Figure 4:
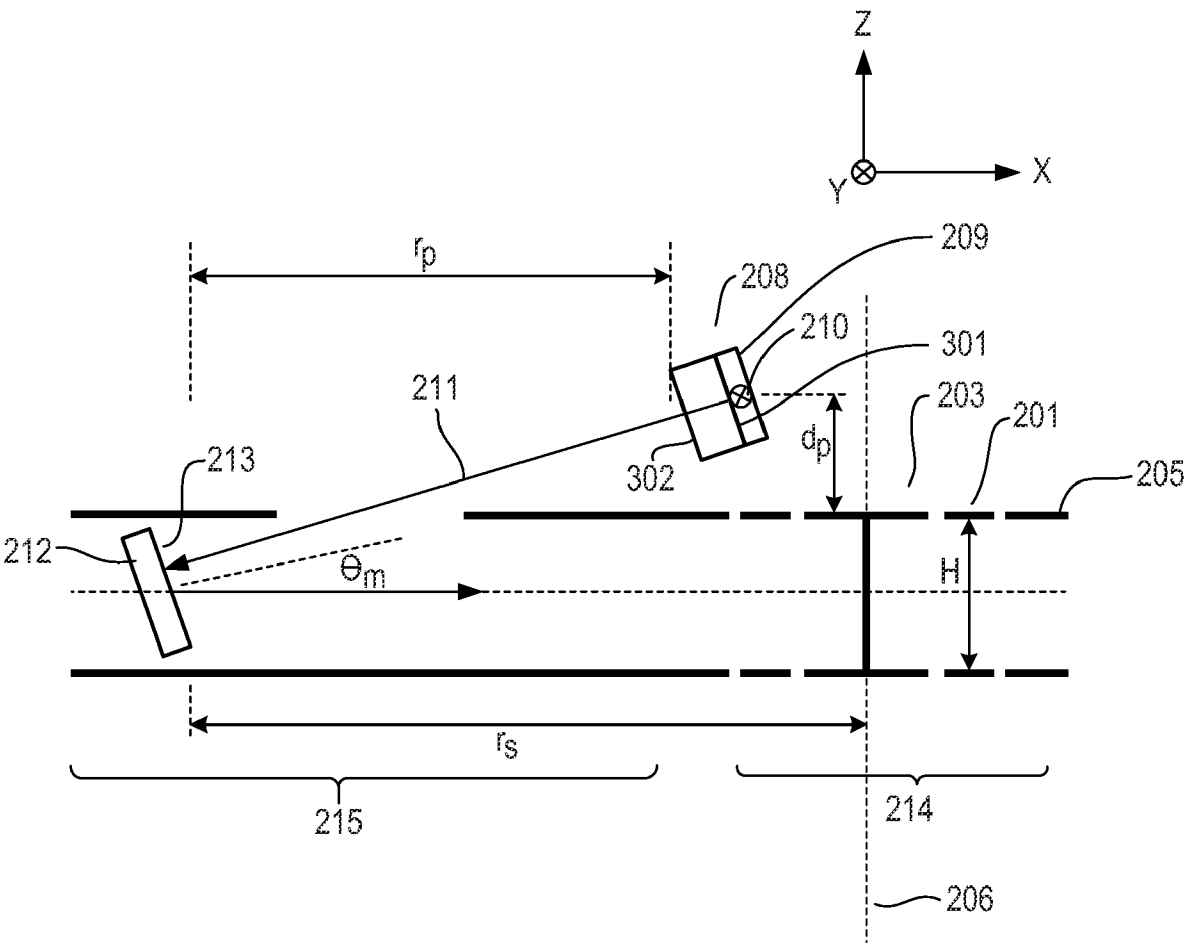
FIG. 4 is a cross-sectional view of a portion of a mass analyzer in accordance with a representative embodiment.

FIG. 4 is a cross-sectional view of a portion of a mass analyzer in accordance with a representative embodiment. FIG. 4 shows the positioning and orientation of the pulser 208 and the ion mirror 212 relative to one another and to the mass analyzer 102. In the present example, the single wire grid 213 of the ion mirror is positioned at a radius ($r_s$) of 175 mm from the radial center of the mass analyzer 102. The separation (H) between two opposing faces of the mass analyzer is 48 mm. The separation ($r_p$) between the second grating 302 of the pulser 208 and the single wire grid 213 of the ion mirror is 150 mm. The distance ($d_p$) between the upper surface of the mass analyzer and the point of incidence of the low energy ion beam 210 at the pulser 208 is 14 mm. The angle $\Theta_m$ between the incident direction of the ion packet 211 and the normal to the plane of the single wire grid 213 is 7.1°. Notably, the relative positions of the modified Wiley-McLaren pulser and ion mirror have been chosen to minimize the angle $\Theta_m$ under the constraint that the ion packet 211 beam cross the upper plane of the mass analyzer 102 at the opening 207 an adequate distance away from the central lens region (≧50 mm).

The angle, $\Theta_m$, is beneficially minimized because of two ion optic aberrations that grow with angle, $\Theta_m$. These ion optic aberrations deleteriously impact the resolution of the mass analyzer 102 in the following two ways.

Figure 5:
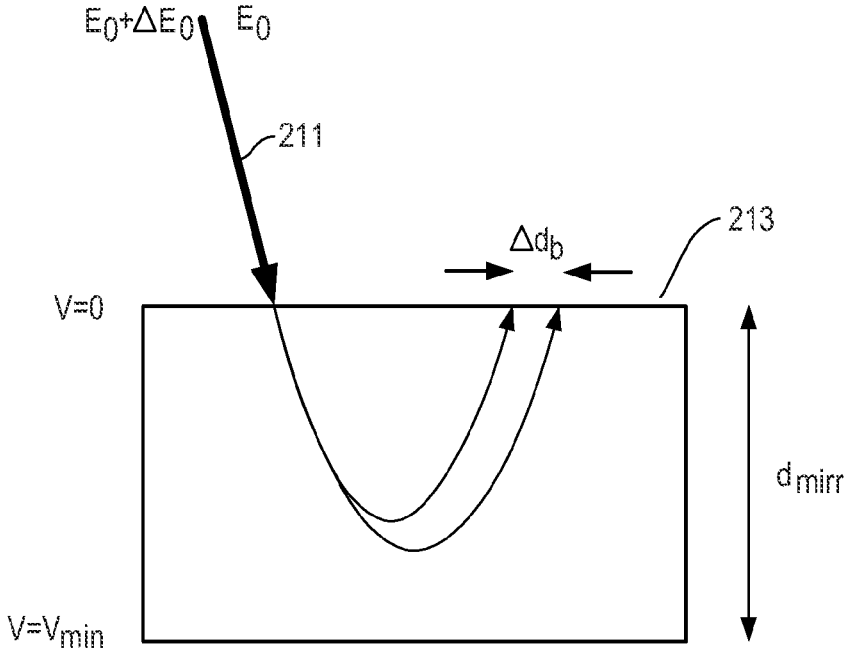
FIG. 5 illustrates beam spreading due in an ion mirror for ions having different kinetic energy.

The first effect is manifest in an increase in the size of the ion packet 211 reflected by ion minor 212 due to the spread in energies within the beam for a nonzero angle of incidence, as illustrated by FIG. 5.

The ion packet 211 is depicted having energies $E_o$ and $E_0+\Delta E_0$ to provide an energy spread $\Delta E_o$. This spread in the energy of the ion packet results in one portion of the beam traveling more deeply into the ion mirror as depicted in FIG. 5.

It can be shown that the beam diameter increase $\Delta d_b$ as a function of the angle of incidence $\Theta_m$ is given by:

$$\Delta d_b = \frac{2\Delta E_0 \sin(2\Theta_m) d_{mirr}}{V_{mirr}}$$

where $\Delta E_o$ is the energy spread of the ion packet 211 (e.g., 233.4 eV), $d_{mirr}$ is the mirror depth (e.g., 20.0 mm), and is the mirror voltage (e.g. $V_{mirr}$=8000 volts). For the illustrative parameters, the beam diameter increase $\Delta d_b$ is approximately 0.29 mm. The acceptable beam diameter for the mass analyzer 102 described in the reference applications to Flory, et al. is on the order of 1.0 mm. As such, the beam diameter increase $\Delta d_b$ is beneficially minimized by minimizing the angle of incidence $\Theta_m$.

Figure 6:
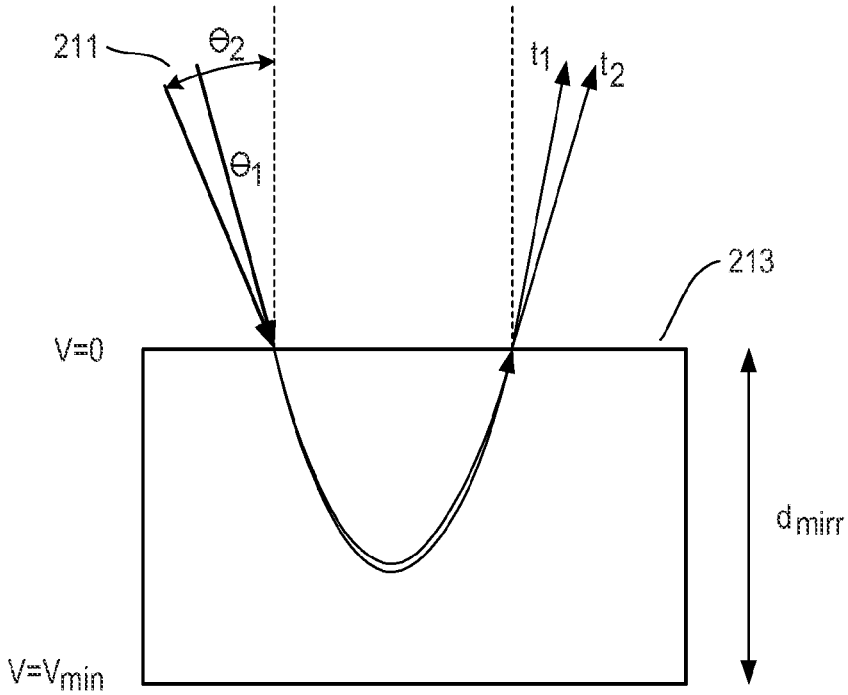
FIG. 6 illustrates beam spreading in an ion minor for ions having substantially identical kinetic energy and a spread in the angle of incidence upon the ion mirror.

Another ion optic aberration that can adversely impact is a result of an angular spread for ions of ion packet 211 having substantially equal energy. As depicted in FIG. 6, ion packet 211 is incident on ion mirror 212, where the angle of incidence relative to the normal to the single wire grid 213 of ion packet 211 having the same kinetic energy differs. This second ion optic aberration results in ions of the same kinetic energy that enter the ion mirror 212 at different angles ($\Theta_1$, $\Theta_2$) relative to the normal to the single wire grid 213, exit the ion mirror 212 after different time delays ($t_1$, $t_2$) as illustrated by FIG. 6. This effect grows with the incident angle of the ions, with the change in time delay with incident angle ($\Theta$) given by:

$$\frac{dt}{d\theta} = \frac{2\sqrt{2E_0}\, d_{mirr}\sin(\theta)}{V_{mirr}} m^{1/2}$$

where $E_0$ is the ion kinetic energy (e.g., 7000 eV), t is the time delay in the ion mirror 212, Θ is the ion velocity angle with respect to the normal to the single wire grid 213 of the ion mirror 212 and m is the mass of the ion (e.g. 1000 amu). Using this equation, for an angular spread of +0.01° the time-delay spread is approximately 0.1 ns. Because the typical width of the time pulse for the exemplary mass analyzer 102, with ions of mass 1000 amu, is on the order of a nanosecond, it is clear that $\Theta_m$ is beneficially minimized to the extent feasible and the angular spread of the ion packet 211 should also be minimized to the extent feasible.

Another ion optic aberration that must be considered when locating and orienting various components of the mass spectrometer 100 relates to the orientations of the first grating 301 and the second grating 302 of the pulser 208, and the single wire grid 213 of the ion mirror 212. As noted above, the first grating 301 and the second grating 302 of the pulser 208, and the single wire grid 213 each comprise a plane of parallel electrically conductive wires, illustratively depicted as wires 701 in FIG. 7. These parallel planes of wires 701 are designed to electrically separate regions of high electric field (within the pulser and mirror interiors) from the nominally zero electric field region between the respective components. The pitch and diameters of wires 701 are chosen to provide suitable ion transmission while maintaining suitable electric field isolation, as is well known to one skilled in the art.

An exemplary wire grid structure used in this disclosure employs wires 701 of radius 0.0125 mm, with a center-to-center spacing ("a") of 0.25 mm. This structure yields suitable field confinement and has a physical transparency factor of 0.95 (ratio of open to total grid area). However, a consequence of having the wire grid in the path of the ion trajectories is that the ions of ion packet 211 are scattered from the wires 701, leading to added angular divergence in the resultant ion beam, as depicted at 702 in FIG. 7. The scattering of the ions of the ion packet 211 can be significant, and must be analyzed for the present structure. Straightforward calculations show that the maximum deviation angle (in radians) induced by wire grid scattering is given by:

$$\theta_{scat}^{(max)} = \frac{q\varepsilon_0 a}{4E_0}$$

where q is the ion charge, $\epsilon_0$ is the electric field within the grid-enclosed volume, "a" is the wire spacing, and $E_0$ is the energy of ions of ion packet 211. For the exemplary structures disclosed herein, the grid scattering from the ion mirror yields $\theta_{scat}^{(max)}=0.20°$ The grid scattering from the pulser 208 yields:

$$\theta_{scat}^{(max)}=0.13°.$$

Figure 7:
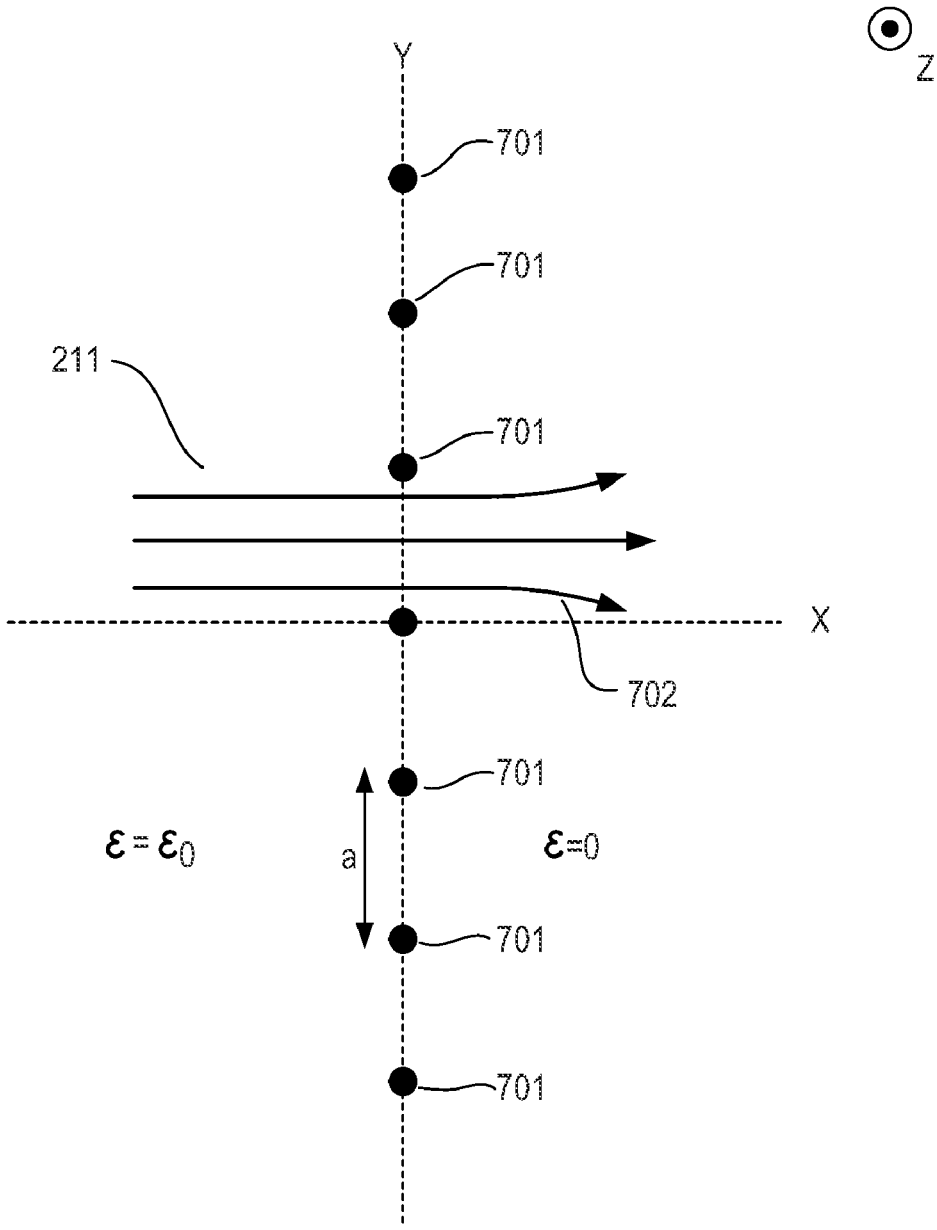
FIG. 7 depicts motions of an ion packet through wires of a pulser in accordance with a representative embodiment.

The scattering 702 only occurs in the plane perpendicular to the wires comprising the wire plane (i.e. the y-dimension of FIG. 7). This scattering asymmetry must be considered in the overall design of the pulser 208 and ion mirror 212. As described above, an angular divergence in the ion packet 211 along the axial dimension (z-direction in FIG. 2D) of the mass analyzer 102 leads to a spread in the time delays in the ion mirror 212 as shown in FIG. 6. As was shown above, an angular spread of ±0.01° in this dimension can result in a time spread of 0.1 nanoseconds of the ions of the ion packet 211, with the time spread scaling roughly linearly with angular spread. Therefore, if the effects of grid scattering due to the first and second gratings 301, 302 of the pulser 208 or the single wire grid 213 of the ion minor 212 were in the axial dimension, the ions of ion packet 211 would have an additional induced time spread of 1.3 nanoseconds or 2.0 nanoseconds, respectively. Either of these contributions to the ion beam time-pulsewidth would result in an unacceptable degradation in the resolution of the mass analyzer 102.

To prevent degradation in the resolution of the mass analyzer 102, the respective planes of parallel wires of the first and second gratings 301, 302 of the pulser 208 must be advantageously aligned. Specifically, the wires 701 of the gratings of the pulser 208 must be parallel to the plane formed by the outgoing trajectory of ion packet 211 and the axis of symmetry 206 of the mass analyzer 102. In this way, the angular divergence in the ion packet 211 induced by scattering from the wires 701 of the pulser 208 will have no velocity component in the axial dimension, and thus no deleterious effect upon the resolution of the mass analyzer 102 as described above. Similarly, the wires 701 of the grating of the ion minor 212 must also be parallel to the plane formed by the trajectory of the ion packet 211 and the axis of symmetry 206 of FIG. 2D. In this way, the angular divergence in the ion packet 211 induced by scattering from the grid wires of the ion mirror 212 will have no velocity component in the axial dimension, and thus no deleterious effect upon the analyzer resolution as described above.

While example embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. A mass spectrometer, comprising:

a mass analyzer, comprising: a pair of planar electrode structures, an ion mirror disposed between the pair of planar electrodes, the electrode structures being disposed opposite one another, parallel to one another, and axially offset from one another, wherein one of the pair of planar electrodes comprises an opening;

an ion source comprising: an ion pulser disposed outside of the mass analyzer and configured to direct ions into the opening in the one planar electrode; and an ion detector.

2. A mass spectrometer as claimed in claim 1, wherein the ion pulser comprises a grid configured to receive ions traveling in a plane parallel to a plane of the electrodes and to direct the ions to the opening.

3. A mass spectrometer as claimed in claim 2, wherein the grid is oriented along a second plane.

4. A mass spectrometer as claimed in claim 1, wherein the ion mirror is configured to reflect the ions in a direction parallel to a plane of the electrodes.

5. A mass spectrometer as claimed in claim 1, wherein the ion mirror comprises a single-stage ion mirror.

6. A mass spectrometer as claimed in claim 1, wherein the electrode structures are configured to generate, in response to a common pattern of voltages applied thereto, a cylindrically-symmetric, annular electric field surrounding a cylindrical central region, the electric field comprising an annular axially focusing lens region surrounding the central region, and an annular mirror region surrounding the lens region.

7. A mass spectrometer as claimed in claim 1, wherein the electrode structures are configured to generate, in response to an applied voltage, a cylindrically-symmetric, annular electric field comprising an annular radially focusing central lens region surrounding an axis of symmetry, and an annular mirror region surrounding the annular radially focusing central lens region.

8. A mass spectrometer as claimed in claim 7, wherein the electric field further comprises a field-free region between the annular radially focusing central lens region and the annular mirror region, and the ion mirror is disposed in the field-free region.

9. A mass analyzer, comprising:

a pair of planar electrode structures, the electrode structures disposed opposite one another, parallel to one another, and axially offset from one another, wherein one of the pair of planar electrodes comprises an opening; and an ion mirror disposed between the pair of planar electrodes.

10. A mass analyzer as claimed in claim 9, wherein the ion mirror is configured to reflect the ions in a direction parallel to a plane of the electrodes.

11. A mass analyzer as claimed in claim 10, wherein the ion mirror is arranged to receive the ions through the opening.

12. A mass analyzer as claimed in claim 9, wherein the electrode structures are configured to generate, in response to a common pattern of voltages applied thereto, a cylindrically-symmetric, annular electric field surrounding a cylindrical central region, the electric field comprising an annular axially focusing lens region surrounding the central region, and an annular mirror region surrounding the lens region.

13. A mass analyzer as claimed in claim 9, wherein the electrode structures are configured to generate, in response to an applied voltage, a cylindrically-symmetric, annular electric field comprising an annular radially focusing central lens region surrounding an axis of symmetry, and an annular mirror region surrounding the annular radially focusing central lens region.

14. A mass analyzer as claimed in claim 13, wherein the electric field further comprises a field-free region between the annular radially focusing central lens region and the annular mirror region, and the ion mirror is disposed in the field-free region.

15. A mass spectrometry method, comprising:

directing ions toward an ion pulser;

directing the ions from the pulser to an opening in one of a pair of planar electrodes and toward an ion mirror;

reflecting the ions from the ion mirror to an ion detector.

16. A mass spectrometry method as claimed in claim 15, wherein the reflecting the ions is in a direction parallel to a plane of the electrodes.

17. A mass spectrometry method as claimed in claim 16, wherein the method further comprises:

establishing a cylindrically-symmetric, annular electric field comprising an annular radially focusing central lens region surrounding an axis of symmetry, an annular mirror region surrounding the annular radially focusing central lens region, and a field-free region between the annular radially focusing central lens region and the annular mirror region.

18. A mass spectrometry method as claimed in claim 15, wherein the method further comprises:

establishing a cylindrically-symmetric, annular electric field around a central region, the electric field comprising an annular, axially focusing lens region surrounding the central region, and an annular mirror region surrounding the lens region.

* * * * *